US006467322B2

(12) United States Patent
Nogami et al.

(10) Patent No.: US 6,467,322 B2
(45) Date of Patent: Oct. 22, 2002

(54) PIPE SHAPING METHOD

(75) Inventors: Yasuhiro Nogami; Katsunori Yuzawa, both of Gunma (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 09/789,509

(22) Filed: Feb. 22, 2001

(65) Prior Publication Data

US 2001/0022100 A1 Sep. 20, 2001

(30) Foreign Application Priority Data

Mar. 15, 2000 (JP) ..... 2000-072628

(51) Int. Cl.[7] ..... B21D 3/02

(52) U.S. Cl. ..... 72/121; 72/84; 72/370.1; 72/370.24; 72/370.25

(58) Field of Search ..... 72/82, 83, 84, 72/85, 120, 121, 335, 339, 367.1, 368, 370.1, 370.13, 370.23, 370.24, 370.25; 29/890, 890.08

(56) References Cited

U.S. PATENT DOCUMENTS 5,937,516 A * 8/1999 De Sousa et al. ..... 72/84
6,233,993 B1 * 5/2001 Irie ..... 72/82

FOREIGN PATENT DOCUMENTS

DE 196 42 004 A1 3/1997
JP 11-147138 6/1999
JP 11-179455 7/1999

* cited by examiner

*Primary Examiner*—Ed Tolan
(74) *Attorney, Agent, or Firm*—Foley & Lardner

(57) ABSTRACT

A pipe shaping method forms a narrow neck at one end of a workpiece in the form of an elliptical pipe having a cross sectional shape elongated in a predetermined elongating direction, with a roller. The pipe shaping method includes the following steps of: cutting the end of the workpiece into a shape having first and second projections and first and second recesses which are arranged alternately along a circumference of the end of the workpiece, the first and second recesses of the end of the workpiece being spaced apart from each other in the elongating direction, each of the first and second projections projecting in a longitudinal direction of the workpiece between the first and second recesses each recessed in the longitudinal direction; mounting the workpiece (W) to a pipe holder; disposing the roller around the workpiece; and reducing a cross sectional size of the end of the workpiece by applying a compressive force on the circumference of the end of the workpiece by making such a relative movement between the roller and the workpiece as to revolve the roller relatively around the workpiece, to move the roller relatively in the longitudinal direction of the workpiece, and to vary a distance between the roller and a revolution axis of relative revolution of the roller around the workpiece.

16 Claims, 9 Drawing Sheets

PIPE SHAPING METHOD

BACKGROUND OF THE INVENTION

Conventionally, a method of reducing an end portion of a pipe and the like in diameter is referred to as a spinning work.

Japanese Patent Unexamined Publication No. 11(1999)-147138 discloses a method (spinning work) of forming a pipe 4 (workpiece) having a circular cross sectional shape. In this first related art, a roller 28 of a forming apparatus is compressed against a circumferential end portion of a fixed pipe 4. Simultaneously with this, the roller 28 is revolved and put into the spinning work so as to form a narrow neck 4*c* at the end portion of the pipe 4. During the spinning work, a revolution axis X5 of the roller 28 is eccentric from a longitudinal center line X4 of the pipe 4, to thereby form the narrow neck 4*c* that is eccentric with respect to the longitudinal center line X4 of the pipe 4.

For carrying out the spinning work, the forming apparatus having the roller 28 is needed to be so constructed that the roller 28 is also movable radially with respect to the revolution axis X5 during its revolution. In the first related art, the forming apparatus has a bracket 27 for supporting the roller 28. The bracket 27 is provided with a first taper surface 27*a*. Moreover, the forming apparatus has a ring plate 26 which is provided with a second taper surface 26*a*. The first and second taper surfaces 27*a* and 26*a* abut against each other. The ring plate 26 is moved forward and backward relative to the pipe 4, to thereby allow the roller 28 to move radially with respect to the revolution axis X5.

Similarly to the above first related art, Japanese Patent Unexamined Publication No. 11(1999)-179455 discloses a method of forming a narrow neck 44 (reduced diameter portion) of a pipe 42 which is fixed. In this second related art, a roller 27 of a forming apparatus 10 is compressed against an external circumference at an end portion of the pipe 42, and is revolved during the spinning work for forming the narrow neck 44 with a reduced diameter.

In the forming apparatus 10 according to the second related art, a support shaft 28 for supporting a roller 27 is mounted on a spinning portion 24 via a slide lock plate 26. A plate cam 29 rotating with the slide lock plate 26 during the spinning work allows the support shaft 28 to move in a radial direction of the spinning portion 24.

A rod member 19 of a main shaft 18 penetrates through an axial center of the spinning portion 24. A pivot converting portion 19A converts an axial displacement of the rod member 19 into a rotation relative to the spinning portion 24. The plate cam 29 is driven by the pivot converting portion 19A.

A rotation axis 48 of the spinning portion 24 is deviated from a longitudinal center line 47 of the pipe 42, to thereby form the narrow neck 44 that is eccentric with respect to the longitudinal center line 47 of the pipe 42.

The above first and second related arts make it possible to produce casings such as those for catalytic converters for vehicles with a small number of component parts in a short time.

Each of the above first and second related arts requires the pipe (workpiece) that has a "circular" cross sectional shape. However, the casing for the catalytic converter for the vehicle has an overall configuration preferably as flat as possible so that the casing can be mounted below a floor of the vehicle. Therefore, a workpiece shaped into an "elliptical" pipe is needed for the casing, instead of the circular pipe.

However, according to the first and second related arts, spinning an elliptical pipe (workpiece), instead of the circular pipe (workpiece), cannot always produce an elliptical pipe (product) having a desired narrow neck.

More specifically, FIG. 9 shows an elliptical pipe 70 (workpiece) made of steel having the following dimensions: a wide diameter of 150 mm, a narrow diameter of 105 mm, and a plate thickness of 1.5 mm, with an end portion thereof cut perpendicular to an axial direction. The elliptical pipe 70 (workpiece) is fixed and then put into a spinning work by means of a roller in order to reduce the end portion in diameter to 70 mm. As a result, a gradual reduction in diameter is seen with a pair of slopes 71 (taper) having an intersection angle of 60 degrees (not shown). However, the slope 71 and the narrow neck have an abnormal deformation 72, that is, a wall surface partly rolled inward. As a result, the thus obtained narrow neck (reduced diameter portion) does not have a cross section shaped into a complete round.

SUMMARY OF THE INVENTION

It is therefore an object of the present invention to provide a method of shaping an elliptical pipe (product) through a spinning work.

It is another object of the present invention to make an elliptical pipe (workpiece) usable for shaping the elliptical pipe (product) having a narrow neck which has a cross section shaped into a complete round.

There is provided a pipe shaping method, according the present invention. The pipe shaping method shapes a workpiece in the form of an elliptical pipe having a cross sectional shape elongated in a predetermined elongating direction and extending longitudinally from a first end to a second end, into a form having a narrow neck at least at the first end of the workpiece. The pipe shaping method comprises the following steps of: cutting the first end of the workpiece into a shape having a projection located at a subsidiary vertex portion and a recess located at a principal vertex portion, the projection projecting in a longitudinal direction of the workpiece, the recess being recessed in the longitudinal direction of the workpiece; mounting the workpiece to a pipe holder; disposing a roller around the workpiece; and reducing a cross sectional size of the first end of the workpiece by applying a compressive force on the circumference of the first end of the workpiece by a relative revolving movement between the roller and the workpiece.

DETAILED DESCRIPTION OF THE PREFERRED EMBODIMENT

A first preferred embodiment is concerning a structure of a forming apparatus 10, a second preferred embodiment is concerning a first shaping method by means of the forming apparatus 10, and a third preferred embodiment is concerning a second shaping method by means of the forming apparatus 10.

First of all, in the following preferred embodiments of the present invention, the term "revolution" as well as those in relation thereto are defined as a motion of a body around a closed orbit (like the earth revolves around the sun); contrary to this, the term "rotation" as well as those in relation thereto distinctively defined as a motion of a body in which all the points on a central straight line of the body are fixed (like the earth rotates about its axis).

Figure 1:
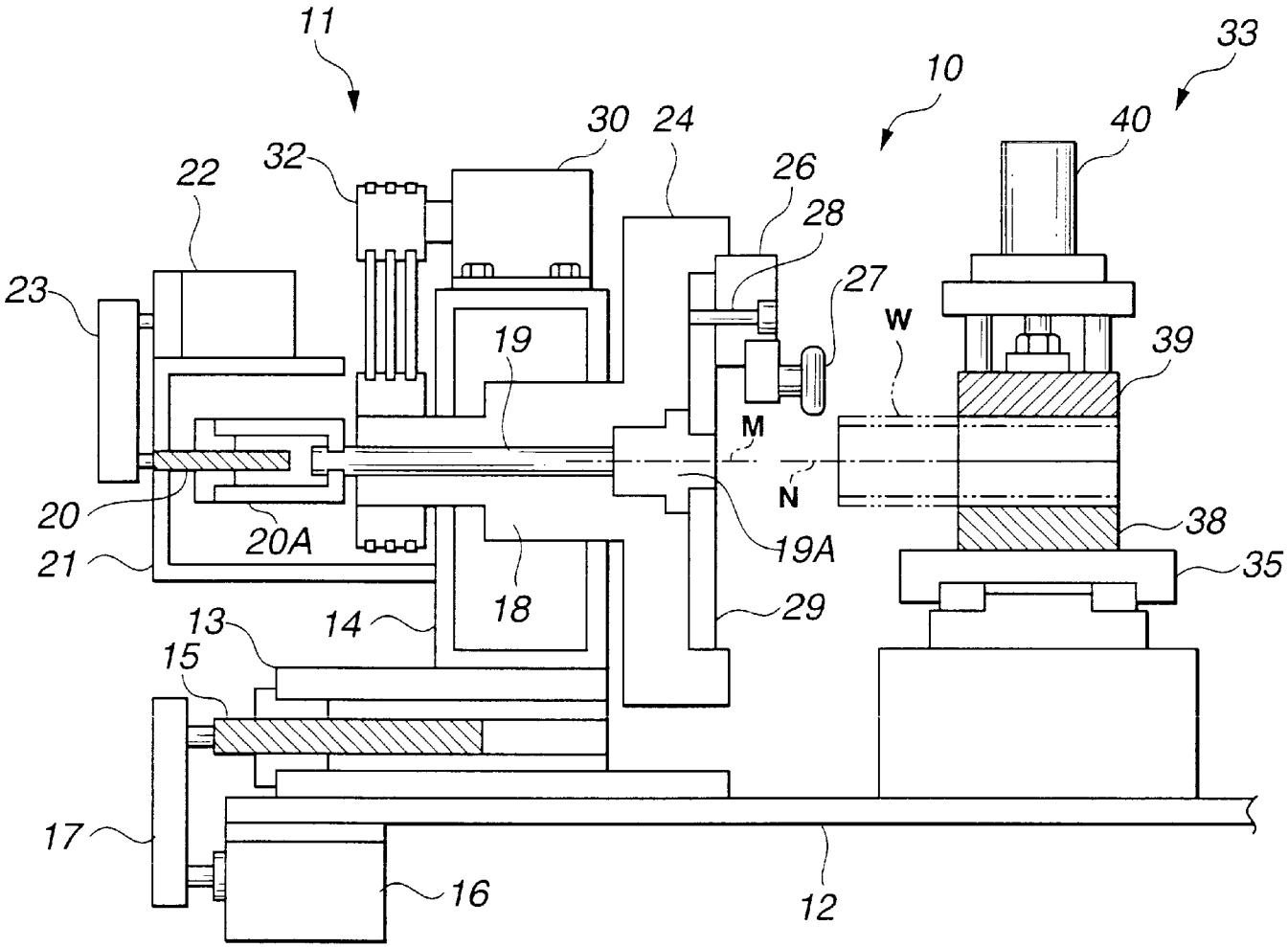
FIG. 1 is a longitudinal sectional view of a forming apparatus 10, according to first, second and third preferred embodiments of the present invention.

As is seen in FIG. 1, there is provided the forming apparatus 10, according to the first preferred embodiment of the present invention. Description of the forming apparatus 10 according to the first preferred embodiment is based on a forming apparatus 10 according to Japanese Patent Unexamined Publication No. 11(1999)-179455 recited in the BACK GROUND OF THE INVENTION above.

The forming apparatus 10 has a forming unit 11 and a pipe holder 33 disposed, respectively, on left and right sides of a base plate 12 in FIG. 1. The forming unit 11 is equipped with a roller 27, and is used for shaping an elliptical pipe W (workpiece W) so that the elliptical pipe W can have a diameter thereof reduced. The pipe holder 33 is used for fixedly holding the elliptical pipe W. The forming unit 11 has a spinning portion 24 which is provided with a plurality of rollers 27. The forming unit 11 further has various driving mechanisms (to be mentioned afterwards) for drivingly holding the spinning portion 24, and is placed on a slide table 13.

The slide table 13 is provided with a first ball screw 15. The forming unit 11 is movable in the longitudinal direction (in other words, a direction toward and away from the pipe holder 33) in FIG. 1 on the base plate 12 via the slide table 13.

More specifically, the first ball screw 15 is rotatably driven via a first pulley belt 17 by means of a first servo motor 16 which is mounted to the base plate 12. Thereby, the slide table 13 is movable in the longitudinal direction in FIG. 1 on the base plate 12.

The forming unit 11 rotatably supports a main shaft 18 to a support member 14 which is fixed to the slide table 13. The main shaft 18 is driven via a second pulley belt 32 by means of a motor 30 which is disposed on the support member 14. The main shaft 18 is provided with the spinning portion 24 on a first side facing the pipe holder 33. The spinning portion 24 has a plate cam 29 which is circular and is rotatably mounted on the spinning portion 24. The plate cam 29 is connected to a rod member 19 via a pivot converting portion 19A. The rod member 19 penetrates through an axial center portion of the main shaft 18. Furthermore, the rod member 19 extends from the pivot converting portion 19A toward a second side opposite to the first side facing the pipe holder 33, and is connected to a converter 20A which is provided with a second ball screw 20. The converter 20A is used for converting a rotational movement into a linear movement, and the linear movement into the rotational movement. The rod member 19 and the converter 20A are rotatable relative to each other.

A cover 21 is fixed to the support member 14 in such a manner as to cover the converter 20A. The second ball screw 20 is driven by means of a second servo motor 22 via a second pulley belt 23. The second servo motor 22 is disposed on the cover 21. Operating the second servo motor 22 allows the rod member 19 to be displaced in its axial direction (transverse direction in FIG. 1). Then, the axial displacement of the rod member 19 allows the plate cam 29 to rotate relative to the spinning portion 24.

Figure 2:
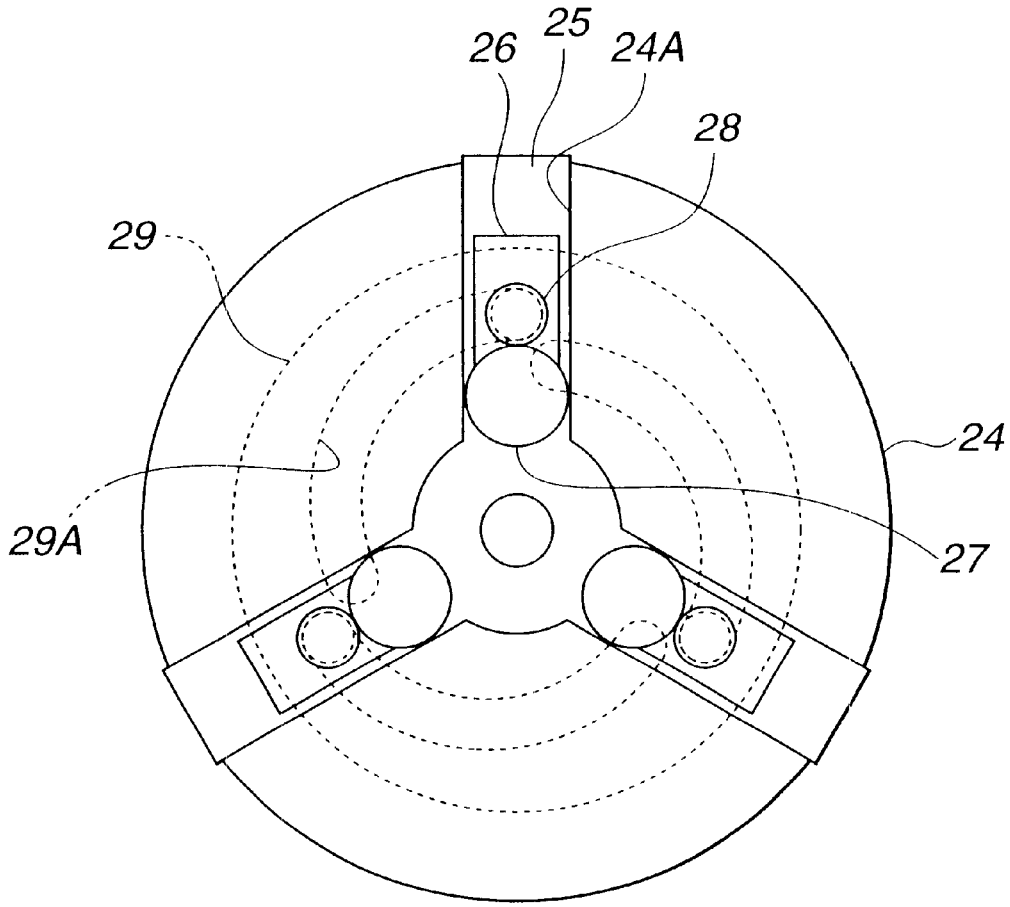
FIG. 2 is a front view of a spinning portion 24 of the forming apparatus 10.

As is seen in FIG. 2, the spinning portion 24 is provided with a plurality of slide grooves 24A extending radially at predetermined angular intervals on the circular spinning portion 24 which is circular in shape. Each of the slide grooves 24A is provided with a slide block 25 which is movable and has a slide lock plate 26 secured to the slide block 25. A support shaft 28 is mounted on each of the slide blocks 25.

As is seen in FIG. 2, there are provided a plurality of cam grooves 29A at predetermined angular intervals on the circular spinning portion 24. Progressing in a clockwise direction in FIG. 2, each of the cam grooves 29A becomes more spaced apart from a center of the spinning portion 24 (spiral). Each support shaft 28 of the slide block 25 projects in an area defined within one of the cam grooves 29A, and is movable along one of the cam grooves 29A.

Each slide lock plate 26 is provided with one of the rollers 27. The plurality of rollers 27 are used for forming, and are disposed at regular angular intervals around a rotation axis M of the main shaft 18. Rotation of the plate cam 29 allows each of the rollers 27 to move radially along one of the slide groove 24A on the spinning portion 24. Moreover, each of the rollers 27 makes a revolution around the rotation axis M of the main shaft 18 in the same circular orbit.

On the other hand, the pipe holder 33 is movable, via a slide table 35, in a direction perpendicular to the movement of the forming unit 11 (also perpendicular to a flat surface of FIG. 1). The slide table 35 is driven by a hydraulic cylinder (not shown). The pipe holder 33 is equipped with an immovable holder 38 on the slide table 35, and a movable holder 39 which is movable upward and downward by means of a hydraulic cylinder 40. Each of the immovable holder 38 and the movable holder 39 has an inside wall portion corresponding to a cross section of the elliptical pipe W. The elliptical pipe W is preferably mounted on the pipe holder 33 in such a manner that the narrow diameters of the elliptical pipe W face upward and downward. According to the first preferred embodiment of the present invention, the narrow diameters of the elliptical material W face upward and downward.

With the elliptical pipe W fixedly held between the immovable holder 38 and the movable holder 39, a longitudinal center line N of the elliptical pipe W and the rotation axis M of the main shaft 18 are, basically, positioned on the same line in the vertical position in FIG. 1. In addition to the basic positioning stated above, the longitudinal center line N and the rotation axis M can be so adjusted as to make a required offset in the vertical position in FIG. 1 by means of an adjuster (not shown).

The first and second servo motors 16 and 22 are controlled by means of a control device (not shown).

The forming apparatus 10 according to the first preferred embodiment of the present invention differs from the forming apparatus 10 according to Japanese Patent Unexamined Publication No. 11(1999)-179455 in that the former puts the workpiece W that is an "elliptical" pipe (instead of a "circular" pipe) between the immovable holder 38 and the movable holder 39. For more details in terms of the structure of the forming apparatus 10, refer to Japanese Patent Unexamined Publication No. 11(1999)-179455.

Hereinafter, there are provided the first and second shaping methods, according to, respectively, the second and third preferred embodiments of the present invention. Each of the first and second shaping methods uses the forming apparatus 10 so as to form, respectively, narrow necks 52A and 52B. Each end on both sides of the elliptical pipe W (workpiece W) is formed with the narrow neck 52A through the first shaping method, while formed with the narrow neck 52B through the second shaping method.

Each of the first and second shaping method is a spinning work by means of the forming apparatus 10. As is seen in FIG. 1, the main shaft 18 of the forming unit 11 is rotated, with the elliptical pipe W fixedly held to the pipe holder 33. Then, the first servo motor 16 drives the forming unit 11 into a movement in the longitudinal direction along the base plate 12, and simultaneously with this, the second servo motor 22 rotates the plate cam 29 so as to change a distance between the roller 27 and the rotation axis M of the spinning portion 24.

Figure 3:
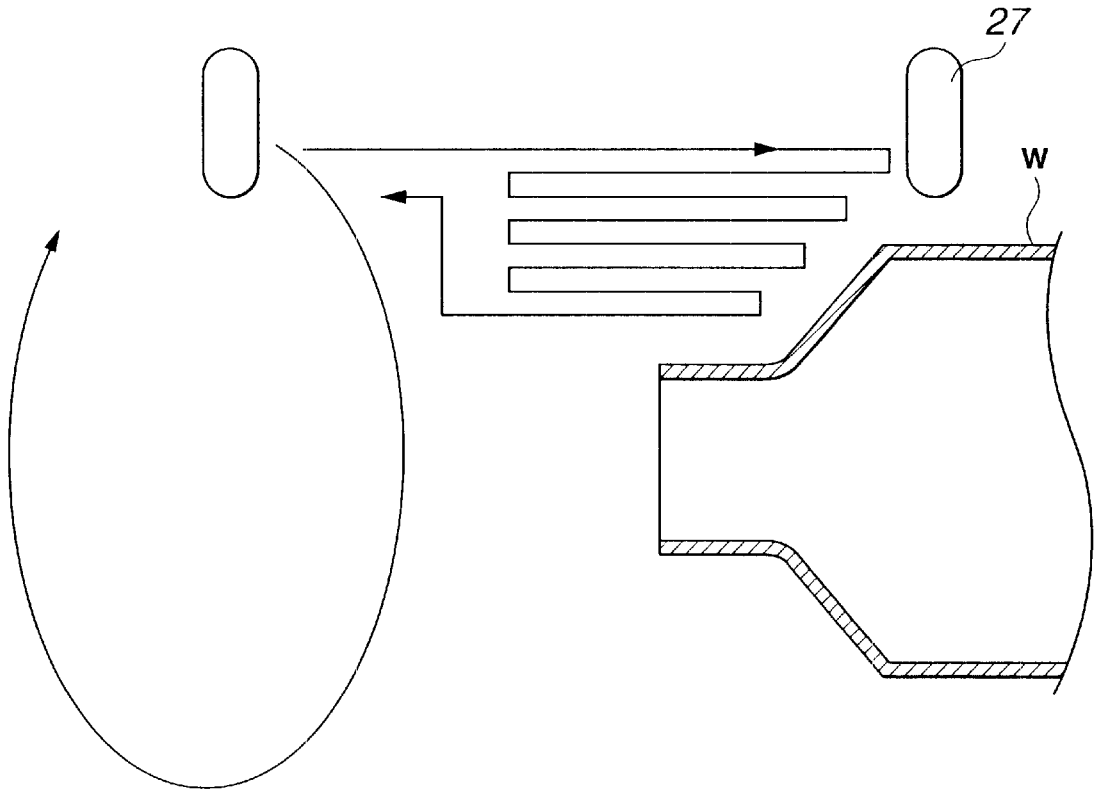
FIG. 3 shows an orbit of a roller 27 compressed against an elliptical pipe W.

In other words, the control device (not shown) controls the first and second servo motors 16 and 22. Thereby, the roller 27 is compressed against a side surface of the elliptical pipe W in FIG. 1, and makes a movement indicated by a zigzag arrow as is seen in FIG. 3. More specifically, the roller 27 carries out three types of movement; one is a revolution around the elliptical pipe W, another is a round trip in an axial direction of the elliptical pipe W, and the other is a radial movement so as to change the distance between the roller 27 and a revolution axis M of the roller 27. With this, the elliptical pipe W is deformed stepwise by a predetermined dimension so as to reduce the elliptical pipe W in diameter until the predetermined narrow neck 52A or 52B is formed.

For each of the spinning works in the first and second shaping methods, the workpiece W has the end that is to be shaped for the reduced diameter. As is best seen in FIG. 4B and FIG. 6B, the end of the workpiece W is so profiled (gently curved like an undulating edge) as to correspond to a wide diameter portion (recess EL) and a narrow diameter portion (projection ES, ES1, ES2) of the ellipse. In other words, the end of the workpiece W is not cut merely vertical nor diagonal with respect to the longitudinal center line N.

Figure 4C:
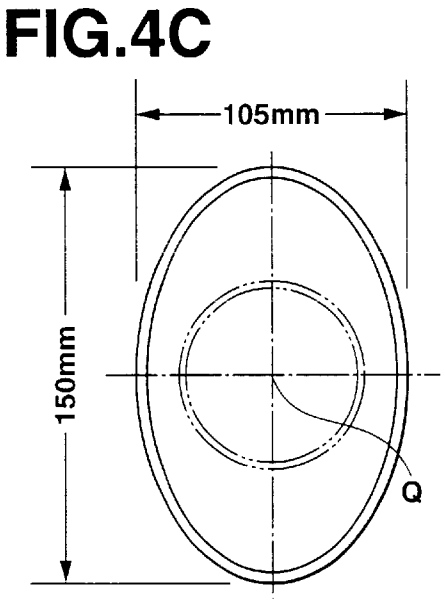
FIG. 4 (4A, 4B and 4C) shows an end shape of a first workpiece material WA (elliptical pipe), with a center Q of a narrow neck 52A coinciding with a longitudinal center line N of the first workpiece material WA.
Figure 4A:
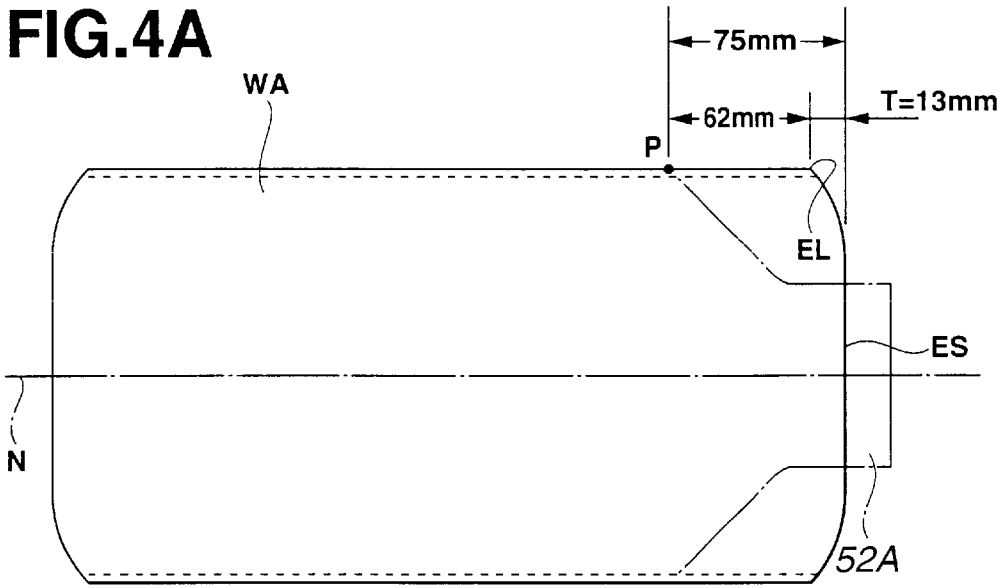
Figure 4B:
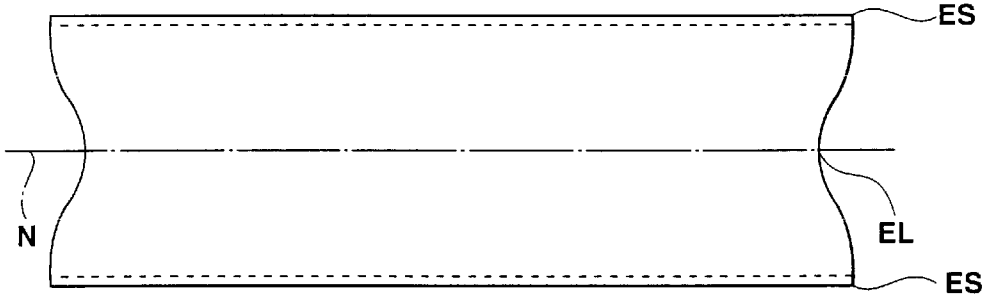

FIG. 4 shows a first workpiece material WA viewed from three different directions, in the first shaping method according to the second preferred embodiment of the present invention. FIG. 4A is a plan view, FIG. 4B is a front view, and FIG. 4C is a side view of the first workpiece material WA. A longitudinal center line of the end of the narrow neck 52A which is cylindrical in shape coincides with the longitudinal center line N of the elliptical pipe WA.

The first workpiece material WA is an elliptical pipe having a narrow diameter of 105 mm and a wide diameter of 150 mm. There are defined a projection ES, a recess EL, and a starting point P for the roller 27 of the spinning portion 24 to start compressing against the wide diameter portion EL. As is best seen in FIG. 4A, the projection ES is set at 75 mm from the starting point P, and the recess EL is set at 62 mm from the starting point P. As is best seen in FIG. 4B, the elliptical pipe is cut along a smooth curve between the projection ES and the recess EL, so as to form the first workpiece material WA. In other words, each of the narrow diameter portions ES (projection ES) on upper and lower sides in FIG. 4B is so positioned as to project from the wide diameter portion (recess EL). The upper and lower sides are symmetrical to each other with respect to a reference line of a workpiece axis N (longitudinal center line N). A length T of 13 mm (75 mm minus 62 mm) is a projection of the narrow diameter portion ES relative to the wide diameter portion EL.

Figure 5C:
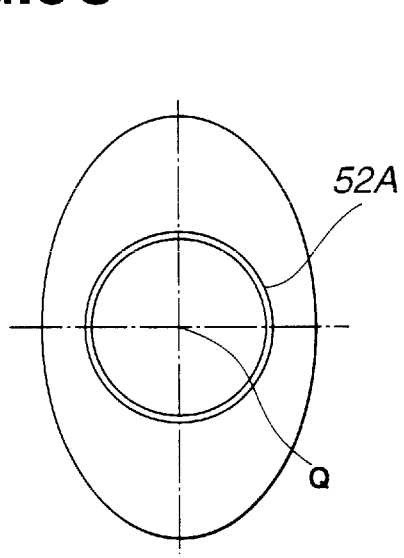
FIG. 5 (5A, 5B and 5C) is similar to FIG. 4, but showing the first workpiece material WA after forming.
Figure 5A:
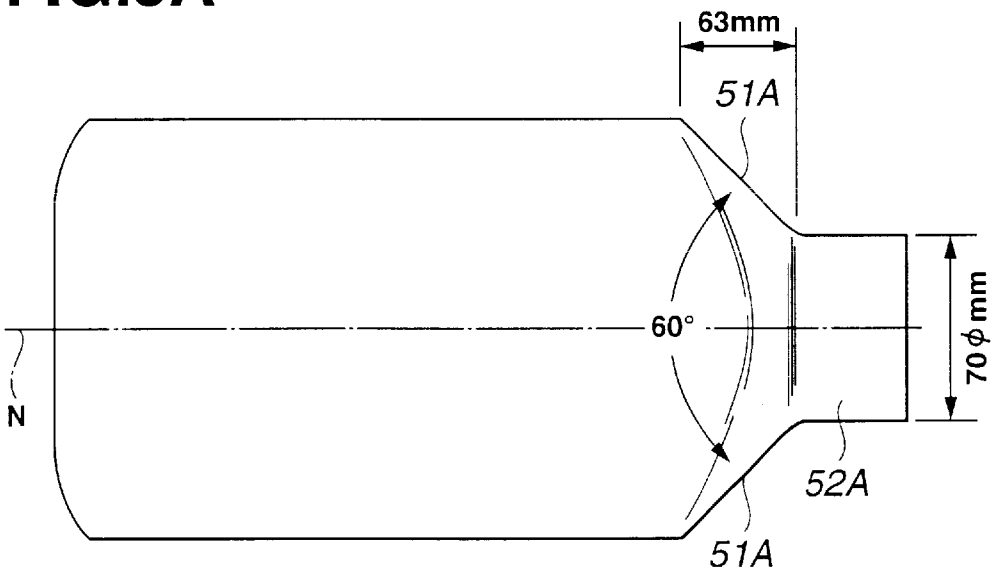
Figure 5B:
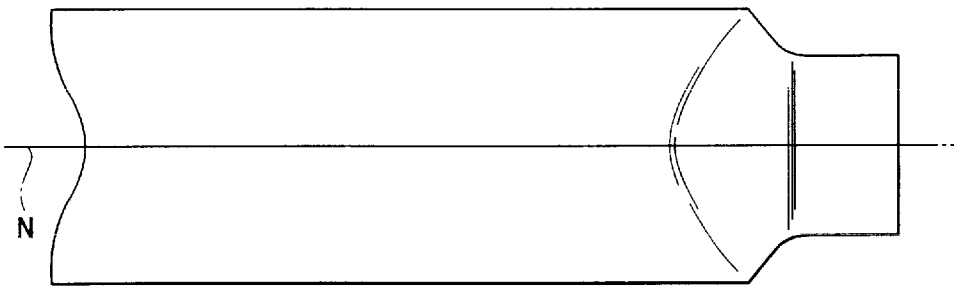

Then, the thus obtained first workpiece material WA is put into the spinning work, to thereby form a casing having a wide diameter slope 51A of 63 mm measured longitudinally, the narrow neck 52A having a diameter of 70 mm, and an intersection angle of 60 degrees between two wide diameter slopes 51A, as is seen in FIG. 5.

Figure 9:
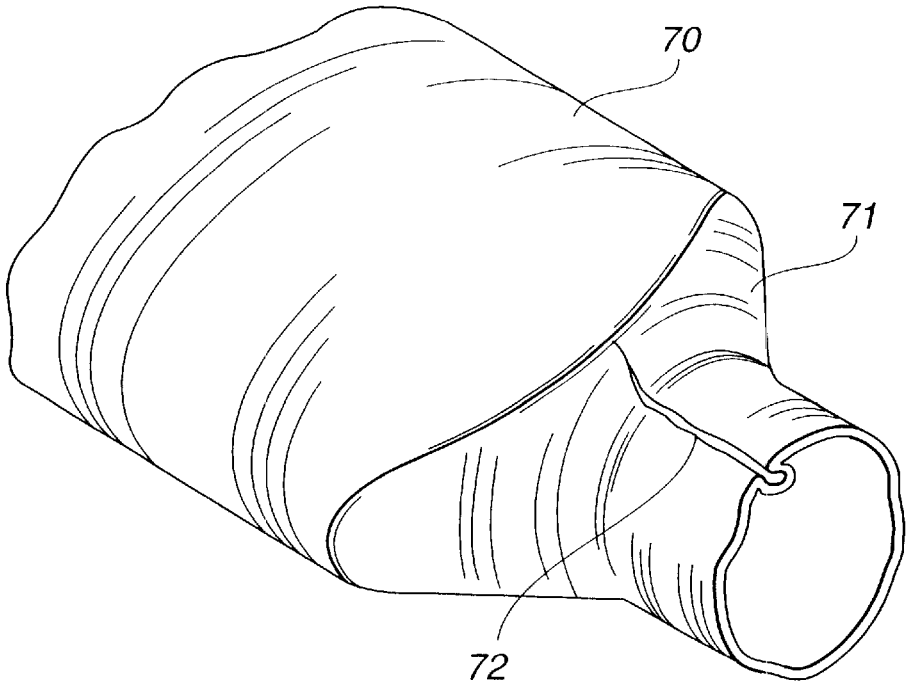
FIG. 9 shows a workpiece 70 after a spinning work, according to a related art.

After the spinning work in the first shaping method, no failure (such as an abnormal deformation 72 seen in FIG. 9) is found in slopes or in the narrow neck 52A.

Figure 6C:
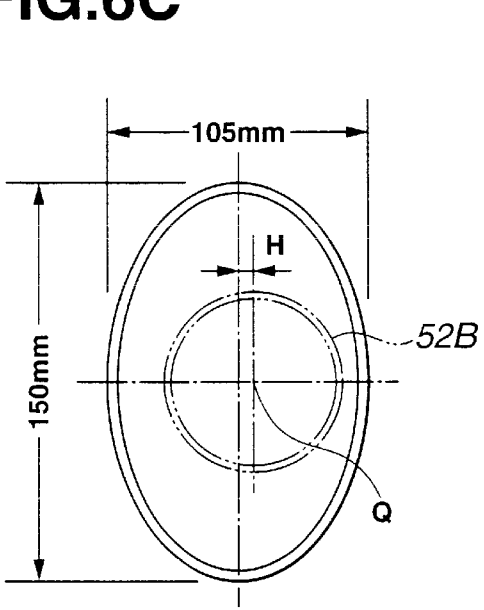
FIG. 6 (6A, 6B and 6C) shows an end shape of a second workpiece material WB (elliptical pipe), with a center Q of a narrow neck 52B deviated by an eccentricity H from a longitudinal center line N of the second workpiece material WB.
Figure 6A:
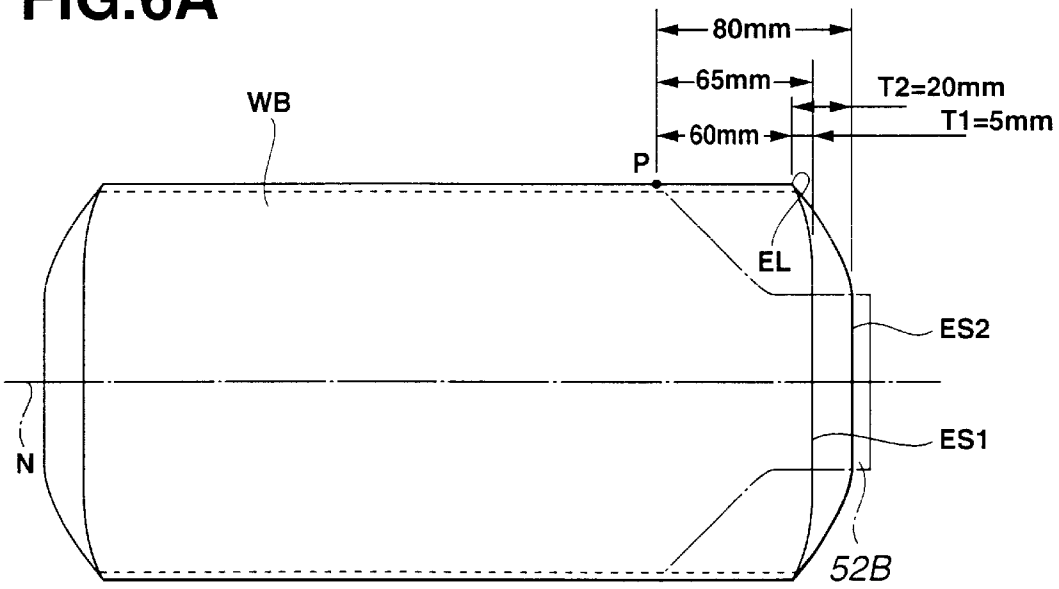
Figure 6B:
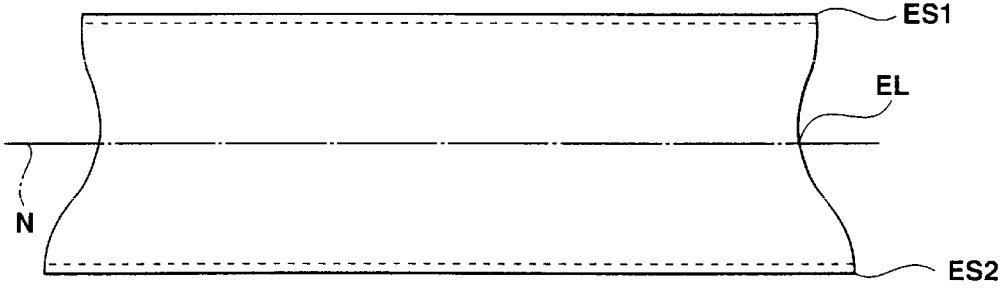

FIG. 6 shows a second workpiece material WB viewed from three different directions, in the second shaping method according to the third preferred embodiment of the present invention. FIG. 6A is a plan view, FIG. 6B is a front view, and FIG. 6C is a side view of the second workpiece material WB. A center axis of the end of the narrow neck 52B is deviated from the longitudinal center line N of the elliptical pipe WB.

In the second shaping method, a center Q of the narrow neck 52B is eccentric in the transverse direction as is seen in FIG. 6C. The direction of deviation is divided into the following first and second cases:

In the first case, the pipe holder 33 holds the elliptical pipe (second workpiece material WB) with narrow diameters of the second workpiece material WB facing upward and downward. The second workpiece material WB is put between the immovable holder 38 and the movable holder 39 in such a manner that the longitudinal center line N of the second workpiece material WB makes an offset (upward in FIG. 1) by an eccentricity H from the rotation axis M of the main shaft 18. Such adjustment is carried out by means of the adjuster (not shown). In other words, the center Q of the narrow neck 52B is deviated lower than the longitudinal center line N in FIG. 6B.

Contrary to this, in the second case, the pipe holder 33 holds the second workpiece material WB with wide diameters of the second workpiece material WB facing upward and downward. The slide table 35 is so moved that the longitudinal center line N of the second workpiece material WB makes an offset by the eccentricity H from the rotation axis M of the main shaft 18 in a direction perpendicular to the flat surface of FIG. 1.

As is seen in FIG. 6, the second workpiece material WB is an elliptical pipe having a narrow diameter of 105 mm and a wide diameter of 150 mm. There are defined a first projection ES1, a second projection ES2, a recess EL, and a starting point P for the roller 27 of the spinning portion 24 to start compressing against the wide diameter portion EL. As is best seen in FIG. 6A, the first projection ES1 is set at 65 mm from the starting point P, the second projection ES2 is set at 80 mm from the starting point P, and the recess EL is set at 60 mm from the starting point P. As is best seen in FIG. 6B, the elliptical pipe is cut along a smooth curve between the first projection ES1, the recess EL, and the second projection ES2, so as to form an end of the second workpiece material WB. A length T1 of 5 mm (65 mm minus 60 mm) is a projection of a first narrow diameter portion ES1 relative to the wide diameter portion EL, and a length T2 of 20 mm (80 mm minus 60 mm) is a projection of a second narrow diameter portion ES2 relative to the wide diameter portion EL. In other words, as is seen in FIG. 6B, the second projection ES2 projects longer than the first projection ES1 by 15 mm (80 mm minus 65 mm) in the direction of the longitudinal center line N.

Figure 7C:
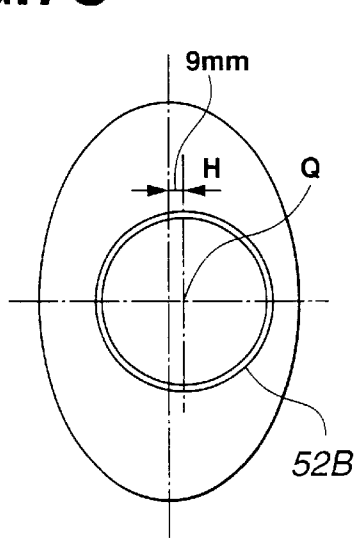
FIG. 7 (7A, 7B and 7C) is similar to FIG. 6, but showing the second workpiece material WB after forming.
Figure 7A:
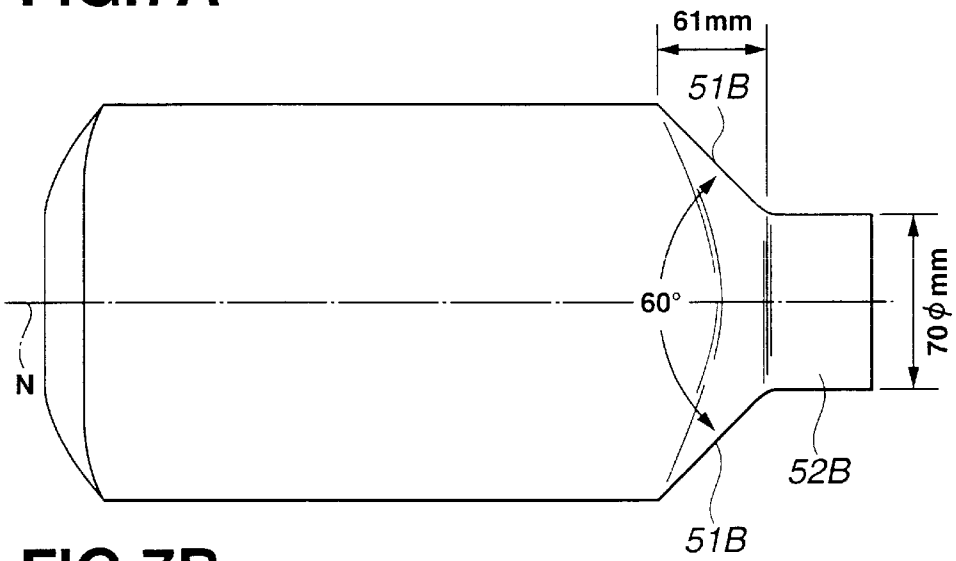
Figure 7B:
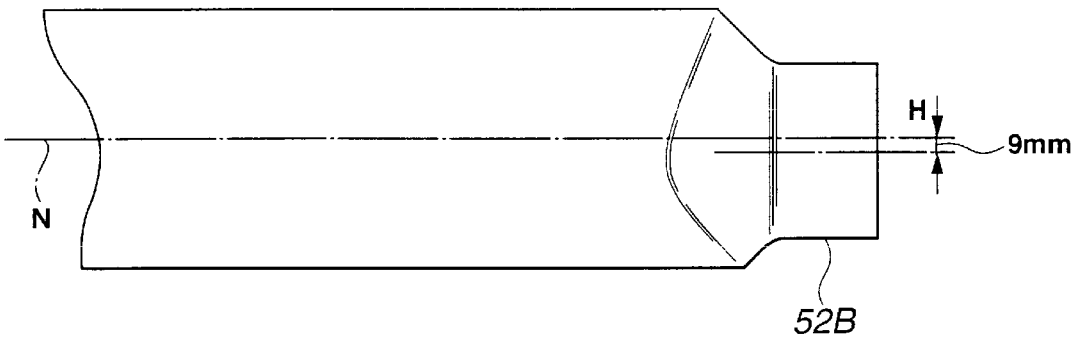

Then, the thus obtained second workpiece material WB is put into the spinning work, to thereby form a casing having a wide diameter slope 51B of 61 mm measured longitudinally, a narrow neck 52B having a diameter of 70 mm, an intersection angle of 60 degrees between two wide diameter slopes 51B, and the eccentricity H of 9 mm of the narrow neck 52B, as is seen in FIG. 7.

After the spinning work in the second shaping method, no failure (such as the abnormal deformation 72 seen in FIG. 9) is found in the slopes or in the narrow neck 52B.

Each of the narrow necks 52A and 52B, respectively, in the first and second shaping methods has an end surface thereof shaped through a cutting work or a sanding work for a desired configuration.

In the first shaping method, the projection ES has a projection longer than the recess EL, as is seen in FIG. 4B. Likewise, in the second shaping method, each of the first and second projections ES1 and ES2 has a projection longer than the recess EL, as is seen in FIG. 6B. As a result, this allows even the elliptical pipe to be shaped into the casing having the narrow neck 52A or 52B each shaped into a cylinder with a desired reduced diameter, causing no failures of the material such as the abnormal deformation 72 shown in FIG. 9.

In the first shaping method, it is preferable that the more elliptical the pipe WA is, the more projecting the length T of the projection ES is, relative to the recess EL. Likewise, in the second shaping method, it is preferable that the more elliptical the pipe WB is, the more projecting each of the first and second lengths T1 and T2 (respectively of the first and second projections ES1 and ES2) is, relative to the recess EL.

In the first shaping method, the center Q of the narrow neck 52A coincides with the longitudinal center line N of the elliptical pipe WA. In this case, the length T of the upper projection ES is equal to the length T of the lower projection ES, as is seen in FIGS. 4A and 4B.

Contrary to this, in the second shaping method, the center Q of the narrow neck 52B is deviated from the longitudinal center line N of the elliptical pipe WB. In this case, the second length T2 of the second projection ES2 (lower) is relatively more projecting than the first length T1 of the first projection ES1 (upper), as is seen in FIGS. 6A and 6B. In this case, the narrow neck 52B is closer to the second projection ES2 than the first projection ES1. In other words, for forming a narrow neck (52B) through the spinning work, it is preferable to allow a projection (ES2, T2) of an edge (ES2) to become relatively more projecting than its counterpart (ES1, T1) of the opposite edge (ES1), when the narrow neck (52B) is closer to the edge (ES2) than the opposite edge (ES1). With this, products can be produced with high accuracy, causing no failures (such as the abnormal deformation 72 seen in FIG. 9).

According to the first, second and third preferred embodiments of the present invention, the forming apparatus 10 has the pipe holder 33 for holding the elliptical pipe W (workpiece W) so as to revolve the roller 27 around the main shaft 18. However, the forming apparatus 10 is not limited to the one for "turning (revolution) the roller" in terms of the spinning work.

Figure 8B:
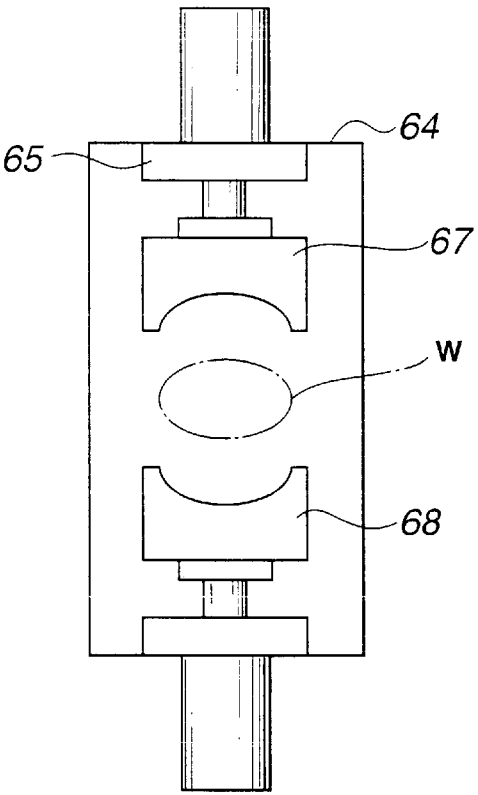
FIG. 8 (8A and 8B) is an essential part of the other forming apparatus with a workpiece W turnable.
Figure 8A:
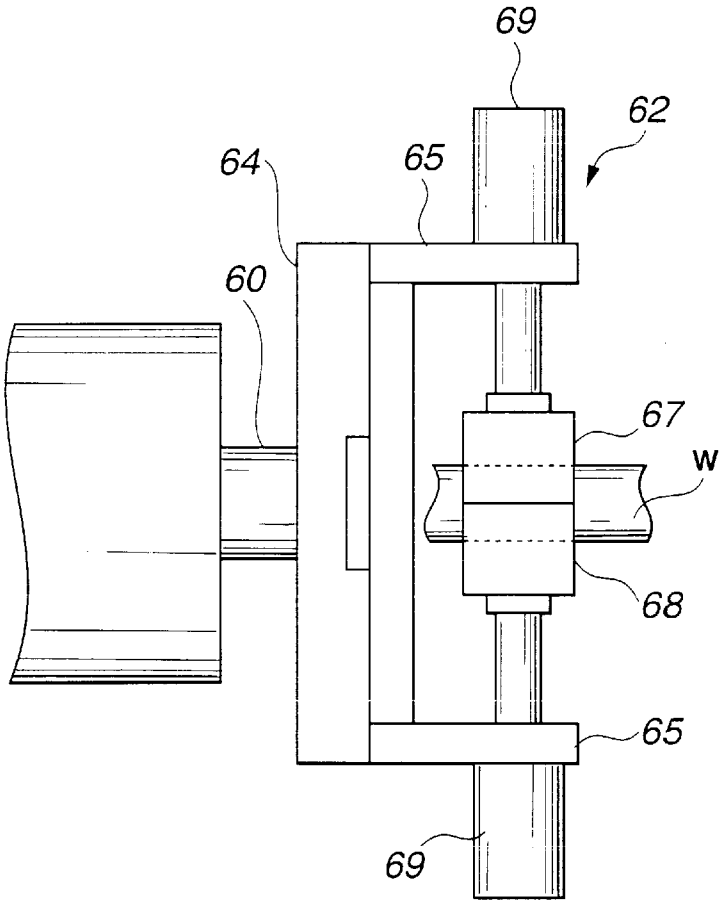

For example, as is seen in FIGS. 8A and 8B, the "workpiece W can be turned." FIG. 8A is a side view showing an essential part of a pipe holder 62 of the other forming apparatus. FIG. 8B is a front view of the pipe holder 62 of the other forming apparatus. The pipe holder 62 is mounted to a rotation shaft 60 which is driven by a motor (not shown). The pipe holder 62 has first and second movable holders 67 and 68 that are held on a holding base plate 64. The holding base plate 64 is fixed to the rotation shaft 60. Each of the first and second movable holders 67 and 68 is mounted on one of support walls 65. One support wall 65 is disposed at an upper end of the holding base plate 64, while the other support wall 65 is disposed at a lower end of the holding base plate 64. The two support walls 65 extend in parallel with the rotation shaft 60. A hydraulic cylinder 69 allows the opposing first and second movable holders 67 and 68 to move toward and away from each other.

FIG. 8A shows that the elliptical pipe W is clamped between the first and second movable holders 67 and 68 of the other forming apparatus. FIG. 8B shows that the first and second movable holders 67 and 68 are spaced apart from each other.

Although not shown in FIGS. 8A and 8B, a mechanism of the other forming apparatus having the following conditions is preferred: A center of a narrow neck of the elliptical pipe W to be formed is defined as an imaginary axis. The roller is not revolved. The elliptical pipe W is so moved as to vary the distance between the roller and the imaginary axis.

As stated above, the forming apparatus has no particular limitations in terms of structure. However, of the two alternatives; one allowing the roller 27 to revolve, the other allowing the pipe holder 62 to turn (with the workpiece W being held), the former is more cost effective than the latter, because the former has a simpler and smaller overall structure than the latter.

Moreover, the second and third preferred embodiments (respectively, first and second shaping methods) show, respectively, the narrow necks 52A and 52B, each of which has a cylindrical shape and is formed adjacent to the tapering slopes. However, the present invention is not limited to this. Alternatively, a narrow neck having no cylindrical shape (in other words; being conical, or having only tapering slopes with gradual reduction in diameter up to an end opening of the workpiece W) is allowed under the present invention.

Furthermore, the second and third preferred embodiments show, respectively, the narrow necks 52A and 52B each having a cross section of a complete round. However, the present invention is not limited to this. Alternatively, a desired shape such as ellipse is applicable to a cross section of a narrow neck. In this case, however, it is necessary to control the roller 27 so that the roller 27 traces its revolution orbit in accordance with the desired shape of the cross section of the narrow neck.

Still furthermore, the second and third embodiments show, respectively, the narrow necks 52A and 52B, each of which disposed at one end of the workpiece W has its counterpart with the same diametral dimension at the other end. However, the present invention is not limited to this. Alternatively, a pair of narrow necks can have different diameters from each other. In this case, however, it is necessary to control the roller 27 in accordance with the corresponding diameter at each end.

What is claimed is:

1. A pipe shaping method of forming a narrow neck at one end of a workpiece in the form of an elliptical pipe having a cross sectional shape elongated in a predetermined elongating direction, with a roller, the pipe shaping method comprising the following steps of:

cutting the end of the workpiece into a shape having first and second projections and first and second recesses which are arranged alternately along a circumference of the end of the workpiece, the first and second recesses of the end of the workpiece being spaced apart from each other in the elongating direction, each of the first and second projections projecting in a longitudinal direction of the workpiece between the first and second recesses each recessed in the longitudinal direction;

mounting the workpiece to a pipe holder;

disposing the roller around the workpiece; and reducing a cross sectional size of the end of the workpiece by applying a compressive force on the circumference of the end of the workpiece by making such a relative movement between the roller and the workpiece as to revolve the roller relatively around the workpiece, to move the roller relatively in the longitudinal direction of the workpiece, and to vary a distance between the roller and a revolution axis of relative revolution of the roller around the workpiece.

2. The pipe shaping method as claimed in claim 1, wherein the reducing step comprises reducing a diameter of the cross sectional size of the end of the workpiece, and wherein the compressive force is applied to the workpiece in a sideward direction perpendicular to the longitudinal direction of the workpiece.

3. The pipe shaping method as claimed in claim 2, wherein a distance between the first projection and the second projection formed by the cutting step is smaller than a distance between the first recess and the second recess.

4. The pipe shaping method as claimed in claim 1, wherein the first and second projections formed by the cutting step are equally projecting.

5. The pipe shaping method as claimed in claim 4, wherein the first and second projections formed by the cutting step are bilaterally symmetrical with respect to a first imaginary median plane extending in the elongating direction and dividing the end of the workpiece into equivalent right and left halves, and wherein a revolution axis of relative revolution of the roller around the workpiece in the reducing step is coincident with a longitudinal center line of the workpiece.

6. The pipe shaping method as claimed in claim 5, wherein the first and second recesses formed by the cutting step are bilaterally symmetrical with respect to a second imaginary median plane perpendicular to the first imaginary median plane.

7. The pipe shaping method as claimed in claim 1, wherein a revolution axis of relative revolution of the roller around the workpiece is deviated from a longitudinal center line of the workpiece.

8. The pipe shaping method as claimed in claim 7, wherein the second projection formed by the cutting step is more projecting than the first projection, and wherein the revolution axis of relative revolution of the roller around the workpiece is deviated from the longitudinal center line of the workpiece toward the second projection.

9. The pipe shaping method as claimed in claim 1, wherein the elliptical pipe comprises a cross section having the shape of an ellipse having a major diameter and a minor diameter, at least a part of the elliptical pipe before the cutting step is bilaterally symmetrical with respect to a first imaginary median plane extending along the major diameter, and bilaterally symmetrical with respect to a second imaginary median plane extending along the minor diameter, wherein the first and second projections are spaced apart from each other along the minor diameter, and wherein the first and second recesses are spaced apart from each other along the major diameter.

10. The pipe shaping method as claimed in claim 9, wherein each of the first and second projections formed by the cutting step is bisected into first and second equal halves by the second imaginary median plane, and wherein each of the first and second recesses formed by the cutting step is bisected into first and second equal halves by the first imaginary median plane.

11. The pipe shaping method as claimed in claim 1, wherein the end of the workpiece is a first end, wherein the workpiece further has a second end, and wherein the pipe shaping method is a method for forming the narrow neck at each of the first and second ends.

12. The pipe shaping method as claimed in claim 1, wherein the first and second projections and the first and second recesses are arranged alternately to form an undulating edge of the elliptical pipe.

13. The pipe shaping method as claimed in claim 1, wherein the workpiece is fixed by means of the pipe holder, wherein the roller comprises a plurality of rollers, and wherein each of the rollers revolves in an orbit around the revolution axis (M) in the reducing step so as to reduce the cross sectional size of the end of the workpiece.

14. A pipe shaping method of shaping a workpiece in the form of an elliptical pipe having a cross sectional shape elongated in a predetermined elongating direction and extending longitudinally from a first end to a second end, into a form having a narrow neck at least at the first end of the workpiece, the pipe shaping method comprising the following steps of:

cutting the first end of the workpiece into a shape having a projection located at a subsidiary vertex portion and a recess located at a principal vertex portion, the projection projecting in a longitudinal direction of the workpiece, the recess being recessed in the longitudinal direction of the workpiece;

mounting the workpiece to a pipe holder;

disposing a roller around the workpiece; and reducing a cross sectional size of the first end of the workpiece by applying a compressive force on the circumference of the first end of the workpiece by a relative revolving movement between the roller and the workpiece.

15. The pipe shaping method as claimed in claim 14, wherein the workpiece extends longitudinally along a longitudinal center line, and comprises two of the subsidiary vertex portions confronting each other across the longitudinal center line and two of the principal vertex portions confronting each other across the longitudinal center line, wherein a distance between the subsidiary vertex portions in a first diametral direction perpendicular to the longitudinal center line is smaller than a distance between the principal vertex portions in a second diametral direction perpendicular to the first diametral direction and perpendicular to the longitudinal center line, and wherein the projection is located at one of the subsidiary vertex portions and the recess is located at one of the principal vertex portions.

16. The pipe shaping method as claimed in claim 14, wherein the cutting step comprises a cutting operation of cutting each of the first end and the second end of the workpiece into the shape having the projection located at the subsidiary vertex portion and the recess located at the principal vertex portion, and wherein the reducing step comprises a reducing operation of reducing the cross sectional size of each of the first end and the second end of the workpiece by applying a compressive force on the circumference of each of the first end and the second end of the workpiece.

* * * * *